US007217002B2

(12) United States Patent
Jungel-Schmid et al.

(10) Patent No.: US 7,217,002 B2
(45) Date of Patent: May 15, 2007

(54) AMBIENT LIGHTING SYSTEM

(76) Inventors: Johannes Jungel-Schmid, Neusetzgasse 9/8, Vienna (AT) A-1100; Dimitre Tochev, Kolschitzkygasse 2-4/1/14, Vienna (AT) A-1040; Ivan Tochev, Kolschitzkygasse 2-4/1/14, Vienna (AT) A-1040

( * ) Notice: Subject to any disclaimer, the term of this patent is extended or adjusted under 35 U.S.C. 154(b) by 0 days.

(21) Appl. No.: 10/565,896

(22) PCT Filed: Jul. 5, 2004

(86) PCT No.: PCT/AT2004/000238

§ 371 (c)(1),
(2), (4) Date: Jan. 24, 2006

(87) PCT Pub. No.: WO2005/010433

PCT Pub. Date: Feb. 3, 2005

(65) Prior Publication Data

US 2006/0187654 A1 Aug. 24, 2006

(30) Foreign Application Priority Data

Jul. 24, 2003 (AT) ..... A 1179/2003

(51) Int. Cl.
*F21S 8/00* (2006.01)

(52) U.S. Cl. ..... 362/147; 362/283; 362/326

(58) Field of Classification Search ..... 362/147–150, 362/283, 293, 299, 300, 301, 326, 355, 433
See application file for complete search history.

(56) References Cited

U.S. PATENT DOCUMENTS 3,668,381 A * 6/1972 Schwartz et al. ..... 362/339
4,400,765 A * 8/1983 Kochem ..... 362/277
4,669,034 A * 5/1987 Bansbach et al. ..... 362/309
4,800,474 A * 1/1989 Bornhorst ..... 362/293
5,823,661 A * 10/1998 Mahanay et al. ..... 362/293
6,402,344 B1 * 6/2002 Palazzo ..... 362/283
6,862,137 B2 * 3/2005 Ott ..... 359/388
6,953,272 B2 * 10/2005 Hayakawa et al. ..... 362/517

FOREIGN PATENT DOCUMENTS

| | | | |
|---|---|---|---|
| DE | 701365 | C | 1/1994 |
| DE | 4307809 | C | 10/1994 |
| EP | 965789 | B1 | 12/1999 |
| FR | 587609 | A | 4/1925 |
| GB | 806124 | A | 12/1958 |

* cited by examiner

*Primary Examiner*—Sandra O'Shea
*Assistant Examiner*—Adam C. Rehm
(74) *Attorney, Agent, or Firm*—Birch, Stewart, Kolasch & Birch, LLP

(57) ABSTRACT

In a room lighting system (1; 27), e.g. an architectural lighting system, including two alignedly arranged refractive elements (9, 10) whose centers are substantially located in the beam axis (11) of a light source (7) and one (10) of which is mounted to be rotatable about said beam axis (11), also the other refractive element (9) is mounted to be rotatable about said beam axis (11), wherein drive means (18, 19; 13 to 17) plus control means (20) are associated with to the two refractive elements (9, 10) for selective rotation in the same sense or in opposite senses, and both of the refractive elements (9, 10) are prism elements, wherein at least the two refractive prism elements (9, 10) are arranged in a common housing (2; 28).

36 Claims, 6 Drawing Sheets

AMBIENT LIGHTING SYSTEM

Figure 1:
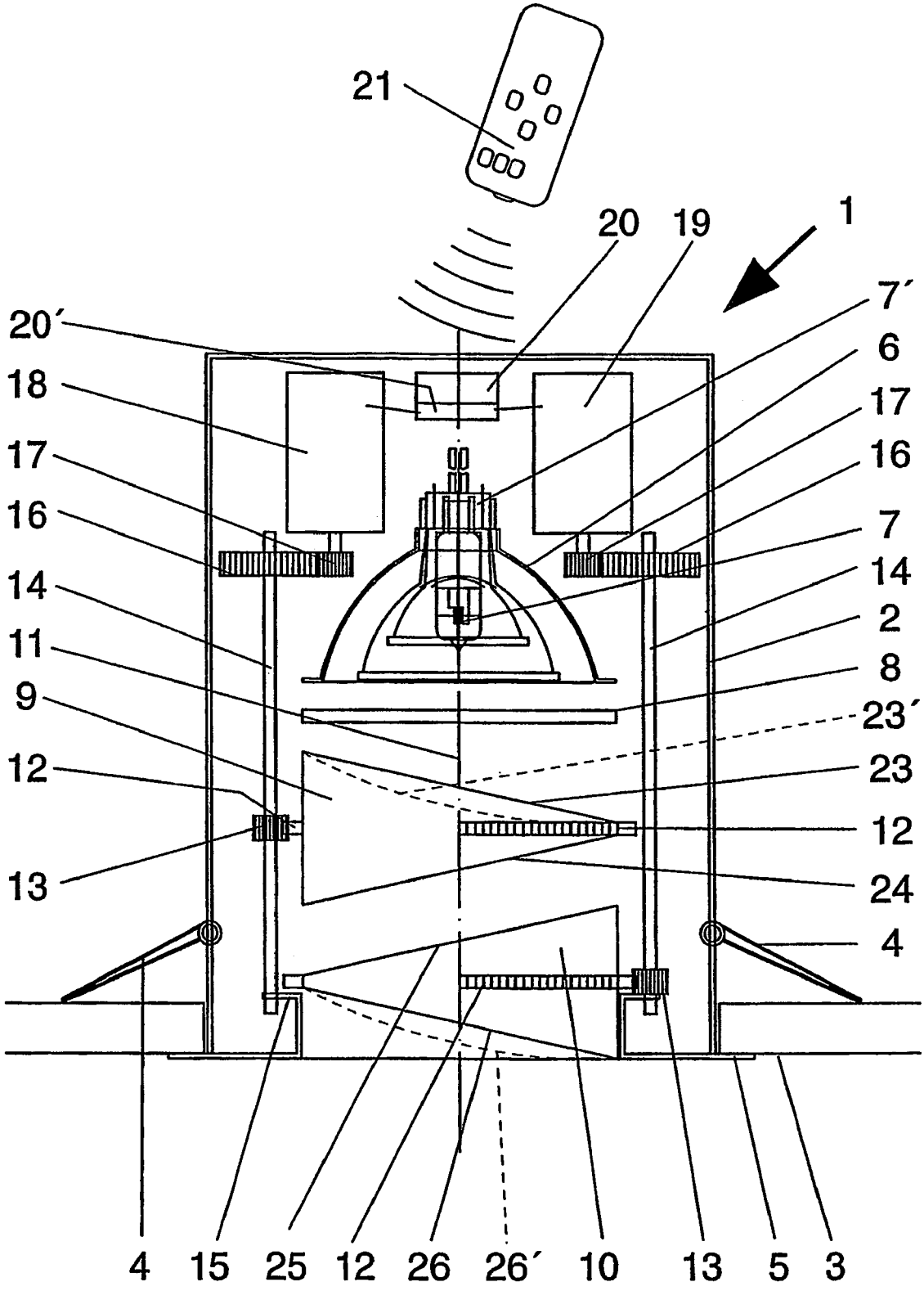

The invention relates to a room lighting system, e.g. an architectural lighting system, including two alignedly arranged refractive elements whose centers are substantially located in the beam axis of a light source and one of which is mounted to be rotatable about said beam axis.

From DE 43 07 809 C, a lighting system is known, in which a single wedge-shaped refractive element is arranged in the beam path of a light source, said refractive element being arranged coaxially with the axis of the bundle of rays from the light source and is rotated about that axis at a relatively high speed of at least 3,600 rpm. The refractive element deflects the light beam by a given angle, which causes the formation of a light-cone surface orbiting at a high speed on a radiation-exposed surface. The adjustment of that lighting system in most cases is effected in a manner that by the orbiting light-cone surface, a surface is exposed to radiation whose diameter is twice as large as the diameter of the light-cone surface orbiting on the radiated surface. This enables the illumination of an enlarged surface in a manner flicker-free to the human eye, which enlarged surface corresponds to the surface swept by the orbiting light-cone surface.

From room lighting systems, it is frequently required to direct a radiation cone to defined regions or objects within a room, or change the direction of the radiation cone for certain reasons. With conventional room lighting systems in which the light source is mounted in the region of a reflector arranged within a housing, a change in the orientation of an emitted light beam is caused by a pivotal movement of the housing. The housing may optionally also be mounted via a cardan joint.

Such a solution involves the drawback of the electric power supply lines having to be moved along at a pivotal movement of the housing such that the pivoting range of the housing is limited by the supply lines, hardly reaching any more than 360°. It is, therefore, required to provide limit switches in a drive for pivoting the housing, which will, at the same time, prepare a reversal of the direction of movement of the housing. This entails accordingly high structural expenditures. In addition, appropriate overlengths of the supply lines must be provided, which will, in turn, render the same more prone to mechanical damage, calling for a suitable protection of the same. This too will increase structural expenditures.

From U.S. Pat. No. 5,775,799 A, a room lighting system and, in particular, architectural lighting system of the initially defined kind is, furthermore, known, two lens discs being arranged in front of a light source in that known room lighting system; the lens discs are profiled optical elements comprising a plurality of thickened and thin zones in order to obtain optical refractions in particular areas. One of the lens discs is adjustable and, for instance, linearly displaceable or even rotatable relative to the second, stationary lens disc in order to thereby enable different combined optical refractions, thus widening or narrowing the light beam emitted by the light source. This enables kind of "zooming", i.e., displacing of the focus in terms of depth such that the light beam impinging on an illuminated surface will, in the end, form a larger or smaller light spot; it is, however, impossible with that known room lighting system to allow the light beam to migrate through the room in order to illuminate, for instance, certain regions of a room such as a workplace or an object exhibited in a room, with the workplace or exhibition site of the object changing.

In general, it is frequently desirable with room lighting systems to move, or let "migrate", a light beam in a predetermined manner in order to achieve certain optical effects.

It is, therefore, an object of the invention to provide a room lighting system of the initially described king, which readily enables changes of direction of the emergent light beam without requiring a complex suspension of the room lighting system and without necessitating special measures to be taken for the protection of the required feed lines.

With a room lighting system of the initially defined kind, this is achieved according to the invention in that also the other refractive element is mounted to be rotatable about said beam axis, wherein drive means plus control means are associated with the two refractive elements for selective rotation in the same sense or in opposite senses, and that both of said refractive elements are prism elements, wherein at least the two refractive prism elements are arranged in a common housing.

By the proposed measures, it is feasible to deflect a light beam coming from the light source within a relatively large area, and direct it in the desired direction, by appropriately actuating the two refractive prism elements. It is thereby feasible to mount the room lighting system as such in a stationary manner and merely adjust the two refractive prism elements by appropriately rotating the same relative to each other, thus causing the light beam to be deflected accordingly due to the respectively combined optical refraction. As a result, the light beam can be deflected in any desired direction—as a function of the adjustment of the prism elements—without moving the light source itself in any manner whatsoever. The light beam emerging from a substantially rigidly mounted light source may, thus, be comparatively widely deflected from the optical axis of the light source as a function of the wedge angle of the prism elements and will, for instance, be able to reach practically every point within a room. The maximum projection area to be swept is determined by the prism angle of the refractive prism elements, as already mentioned, and will be fixed as a function of the respective field of application. In doing so, it is of particular advantage that the technique according to the invention also enables the realization of large light-beam deflections such as, e.g., deflection angles of ±45° relative to the optical axis of the light beam emerging from the light source. Due to the joint arrangement of the prism elements in a common housing, an arrangement of the prism elements in a manner protected from dirt, dust or moisture, and simplified mounting, for instance, to a ceiling or wall of a room have become feasible.

The light source may be designed in any desired fashion, wherein it may also be comprised of a projector or the like, if special optical effects, for instance in a sales room, are sought. In that case, the light beam emerging from the projector can be deflected in any direction by the two independently movable prism elements. The light source may also be comprised of a contour spot or any desired other luminaire using either an edge-focusing projection technique or a color-light technique, or a combination thereof.

An equally rapid counter-sense rotation of the two prism elements will be required to linearly pivot the light cone for deviating from the optical axis defined by the light source, whereas a coupled rotation of the two prism elements in the same sense will be necessary for the light cone to circle around this optical axis. The speeds applied in such cases depend on the respectively desired effects.

It is frequently of particular advantage, if at least one refractive prism element comprises a lens-like bulge on at least one prism surface. It is accordingly beneficial, if at least one refractive prism element comprises a lens-like depression on at least one prism surface. In this manner, the light beam may, moreover, be bundled or scattered as a function of the design of the prism elements in the form of convex or concave wedge lenses, in order to reduce or enlarge the light spot on the illuminated area, or achieve a higher or lower illuminance. In this case, combinations of convex and concave designs may be provided as well.

It is also advantageous if the refractive prism element arranged farther remote from the light source is, in a plane perpendicular to the beam axis of the light source, at least as large as the refractive prism element arranged closer to the light source, and is preferably equally designed. With such a configuration, substantially all of the light beam emerging from the light source is able to pass through the two prism elements even at an unfavorable relative position of the elements, and substantially no losses will, therefore, occur. This will apply, in particular, if the prism element arranged farther remote from the light source is larger than the prism element arranged closer to the light source, and if the prism elements are equally designed.

It is, furthermore, advantageous if the refractive prism elements have circular cross sections. It is, thus, ensured that substantially all of the light beam emerging from the light source in the direction of the prism elements will pass through the same irrespectively of the position of the two prism elements relative to each other.

In order to optimally control the movement of the light beam, it is advantageous if the symmetric lines of the wedge angles of the two refractive prism elements extend substantially perpendicular to the beam axis of the light source.

Yet, it is also basically feasible to arrange one or both prism elements in a manner that one surface of each of said prism elements extends substantially perpendicular to the beam axis of the light source.

If a separate motor is provided as a drive means for each of said refractive prism elements, it is feasible in a simple manner to adjust the two prism elements independently of each other in order to deflect the light beam in any desired direction. For a simple realization of the drive connections, it is advantageous if the refractive prism elements are each surrounded by a toothed ring which meshes with a pinion connected to the associated motor. This measure in a simple manner ensures the respectively independent adjustment of the two prism elements.

In principle, the drive of the two refractive prism elements may also be effected in any other way, e.g., by the aid of a friction drive. The two prism elements, particularly when having circular cross sections, may thus be surrounded by a snugly fitting rubber ring engaged by a friction edge. A toothed-wheel gear, however, offers the advantage that the transmission of a rotational movement occurs in a positive and, hence, highly precise manner without involving the problem of a slip, which can never be ruled out with a friction drive.

For a particularly compact design of the room lighting system, it is, furthermore, favorable if the motors are arranged in the region of the light source and drive the individual refractive prism elements via shafts extending parallel with the beam axis of the light source.

A particularly space-saving mode of construction will be achieved, if the two refractive prism elements are each surrounded by an annular armature, which constitutes the rotor of a respective electromotor additionally comprising, laterally of said armature, a stator including at least two coils.

Bearing in mind the achievable control options, it is, furthermore, advantageous if the motors are step motors. Such step motors, and the control of such step motors, enable the simple storage of positions of the respective step motor and subsequent restarting without requiring separate rotary encoders such as optical rotary sensors, encoders, Hall probes or similar sensor elements. In this context, it is, therefore, also advantageous if a control means including a motor step counting module is associated with said motors designed as step motors for the storage and selection of a position. The above-mentioned shafts may then, for instance, be directly set in rotation by the step motors, thus rotating the prism elements via the pinions and toothed rings.

It is, in principle, also conceivable to control the movements of the two prism elements by departing from a single motor, for instance, by the aid of a gear having two output shafts and a switch mechanism by means of which the direction of rotation of the two output shafts may be switched between a rotation in the same sense and a rotation in opposite senses. It is, moreover, also feasible, besides the already mentioned toothed wheel or friction drive transmissions, to provide belt transmission including V-belts, but also toothed belts, or even worm gears. In addition to these mechanical drive means, electric or electromagnetic drive means without mechanical transmission elements may further be provided, an advantageous example being the previously mentioned configuration comprising an annular armature directly on the prism elements and the associated stator in the region of the armature.

To ensure simple mounting and a compact design, it is further advantageous if also the drive means plus control means as well as the light source, which is preferably associated with a reflector, are arranged in the common housing. Such a configuration enables the room lighting system to be installed in the ceilings, walls or floors of a room in a particularly simple manner.

In order to adjust the light cone of the room lighting system, particularly with a view to obtaining special optical effects, it is, furthermore, advantageous if the drive means of the refractive prism elements are controllable via a remote control. In this manner, the movement of the light beam emerging from the room lighting system is controllable in the desired manner from any location.

The remote control may also be influenced by a processor-controlled converter program, which may be stored in its simplest form in an EPROM in an transmitter/receiver unit. In this respect, preselected settings for adjustments of the two prism elements to be repeatedly called are conceivable too. It is also feasible to provide a low speed of rotation for the adjustment of the prism elements in order to enable, in a processor-controlled room lighting system or one controlled by a manually operated remote control, the quick stop of any further movement upon achievement of a desired position of the light cone.

Furthermore, controlling of the drive means of the two prism elements is conceivable not only via, e.g., an infrared or radio remote control, but also via a hard wiring including its own control lines (bus), particularly for architectural lamps or spots. Moreover, an upmodulated signal transmission may be provided to control the drive means of the refractive prism elements.

For various room lighting systems, the control signals for the drive means of the refractive prism elements may also be derived from another system such as, e.g., a building bus system, and automatically transmitted.

For various applications and special optical effects, it is advantageous if at least one optical component such as a color filter, a lens, a color changer or the like is arranged between the light source and the consecutively arranged refractive prism element. In this manner, it is, for instance, possible to influence the light color, or bundling or refraction, of the color beam emerging from the room lighting system and to adapt the same to the respective requirements.

It is frequently also of particular advantage if an adapter unit is mounted to a housing containing the light source, which adapter unit comprises the common housing in which the two refractive prism elements are arranged. Such a mode of construction enables the retrofitting of usual luminaires with adapter units so as to provide the option of adjusting or moving the light cone within a room in the described manner even with existing luminaires.

The housing of the light source per se might be fixed to the respective room surface or architectural surface irrespectively of the housing of the adapter unit, yet it is particularly beneficial, in order to simplify mounting, if the adapter unit and the housing of the light source comprise connecting members, e.g., plug-in, screw and/or latch members, for mutual connection.

In order to enable small dimensions of the prism elements in the thickness direction, i.e., in the direction of the light beam, it is, furthermore, advantageous if the refractive prism elements are each designed with a plurality of linear prism regions or prism parts in the manner of Fresnel plates. The altogether stepped configuration of the prism elements resulting therefrom provides comparatively low heights of the same so as to enable a low structural height for the room lighting system. This is of particular relevance to room luminaires having large diameters. In this case, it is, furthermore, beneficial if the prism regions or prism parts are frosted or blackened on their surfaces extending at least substantially parallel with the beam axis so as to avoid total reflection. An internal total reflection on these surfaces may, in fact, cause undesired effects on the surfaces of the thus stepped prism elements, which extend parallel with, or at a small angle to, the optical axis. The roughening or frosting of these surfaces causes the light to emerge from the prism elements on these surfaces, yet without provoking a total reflection; the same applies to blackened surfaces, because in this case the light rays will be absorbed on said surfaces and converted into thermal radiation (infrared radiation), whereby an internal total reflection within the prism elements on these surfaces will likewise be avoided or at least strongly reduced.

It should also be mentioned that a motor-vehicle headlamp in which two relatively rotatable prism discs are provided to laterally or downwardly adjust a light beam passing through the same is, for instance, known from FR 587 609 A. This is basically a manual adjustment of the headlamps to obtain a correct orientation of the light beam while avoiding the dazzling of the drivers of approaching vehicles. A similar motor-vehicle headlamp configuration is further described in DE 701 365 C, wherein in that case two prism discs are provided, which are coupled with a common pinion and, hence, rotatable in opposite senses at equal speeds. The pinion is, in particular, coupled with the steering system in order to accordingly reorient the direction of the emitted light beams at a turn of the steering wheel.

Figure 2:
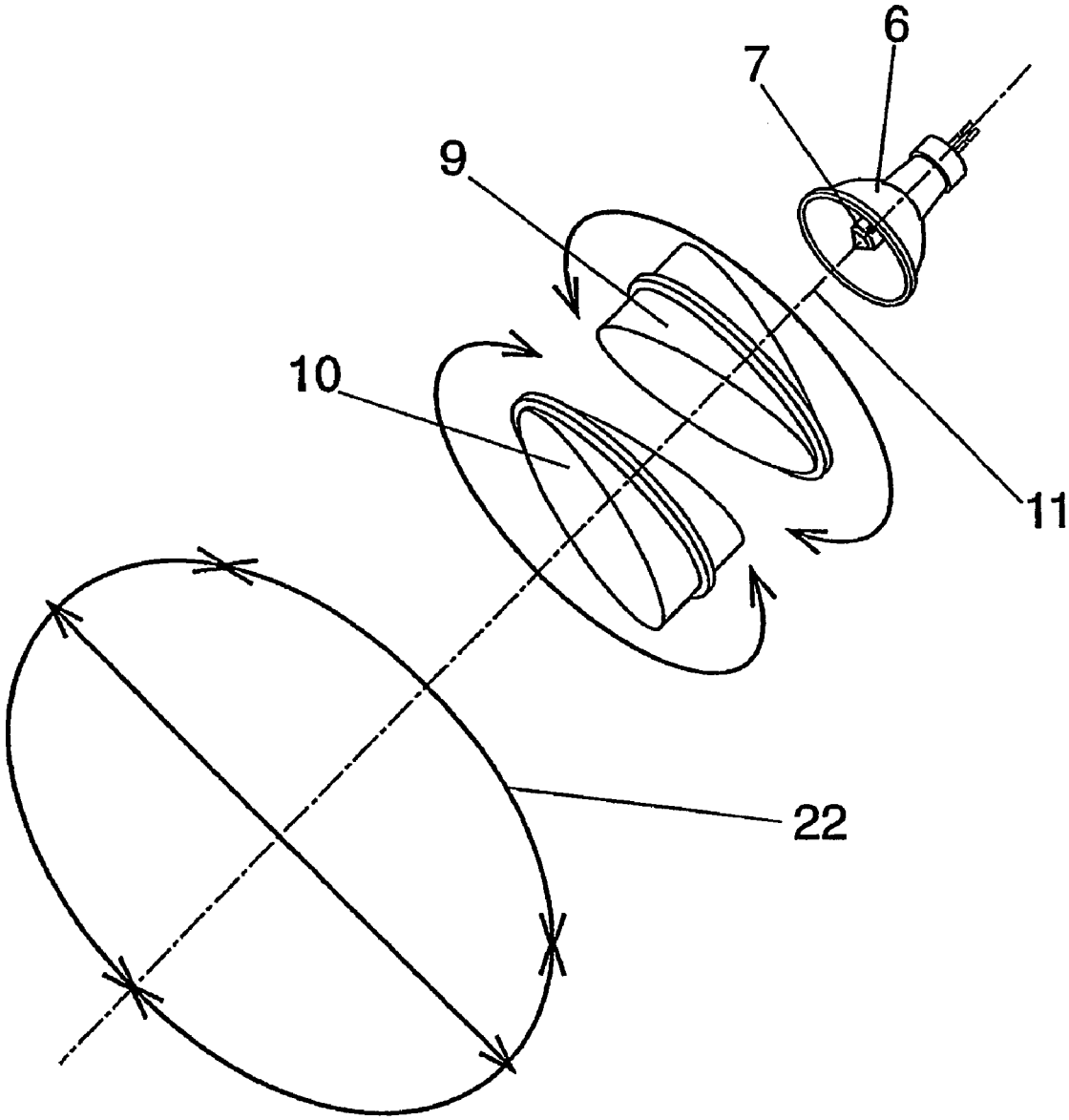
Figure 3:
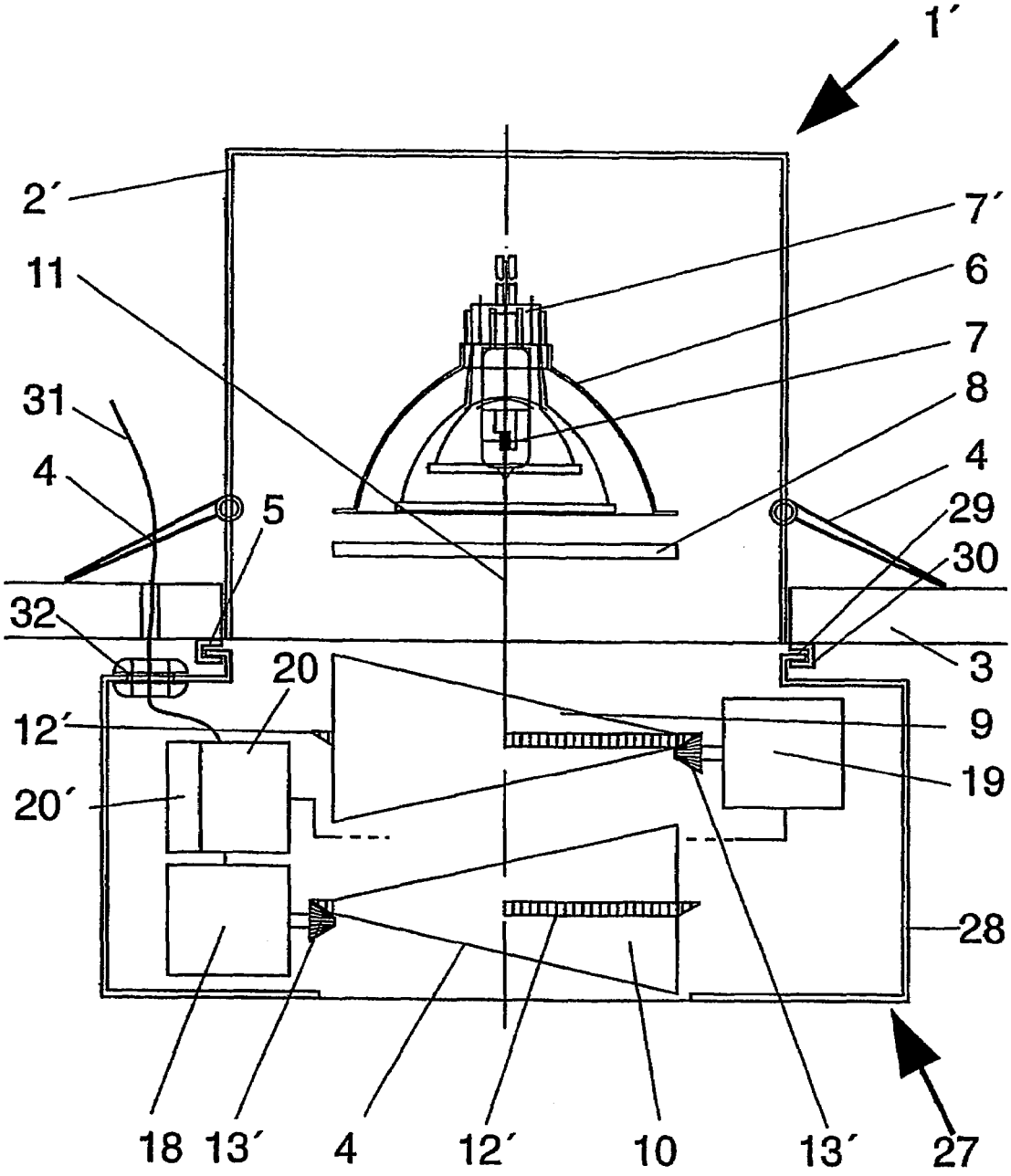
Figure 4:
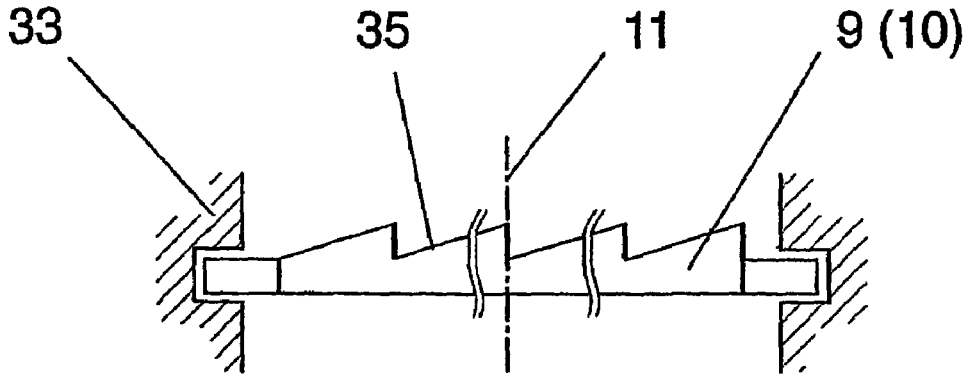
Figure 4:
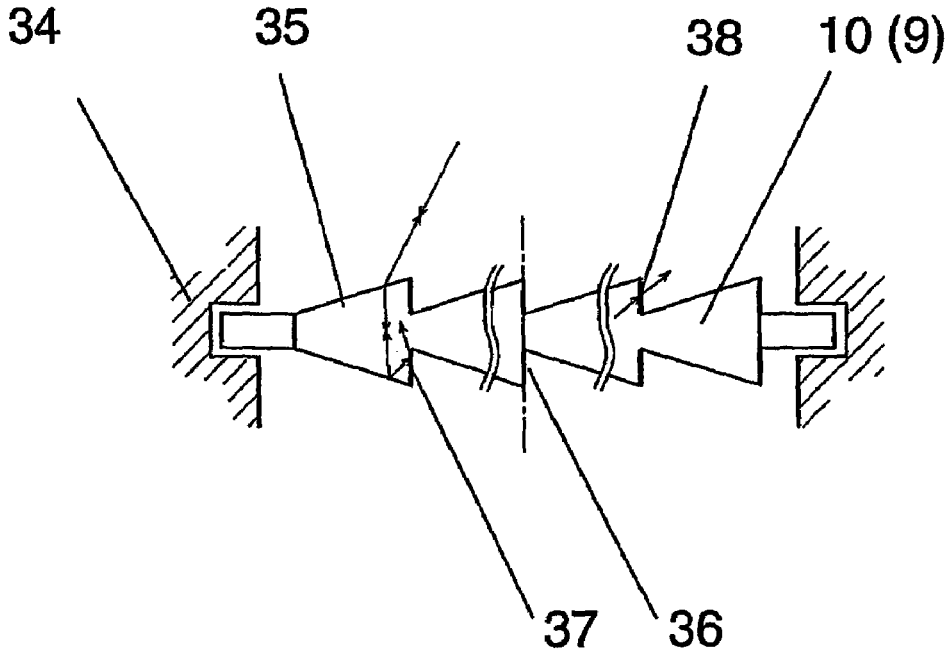
Figure 5:
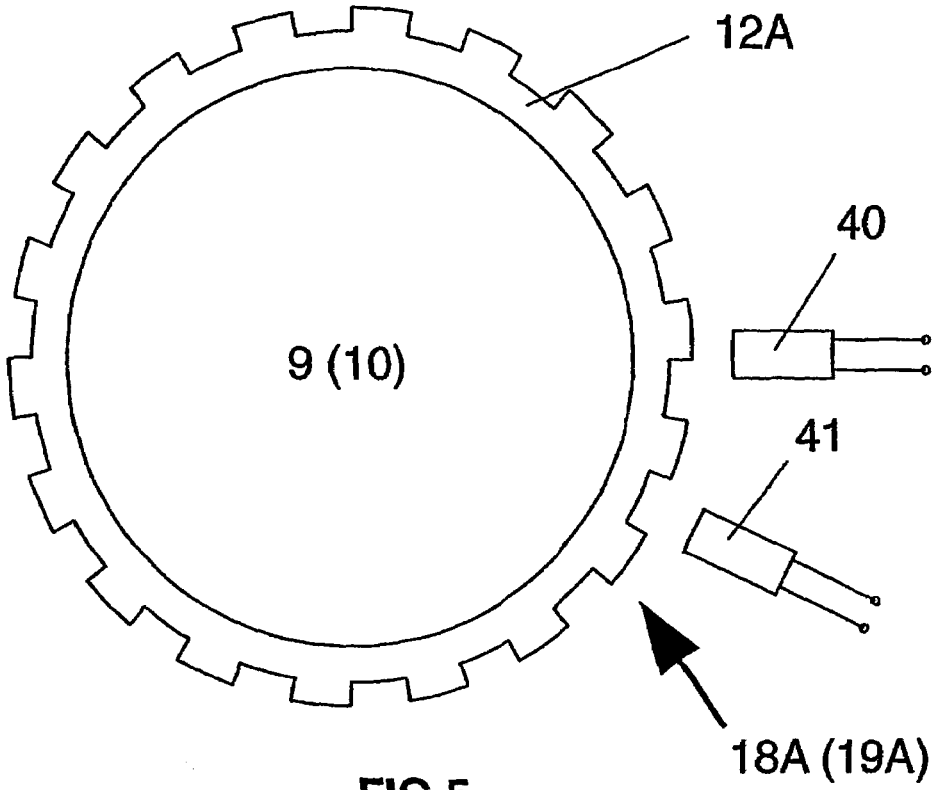
Figure 6:
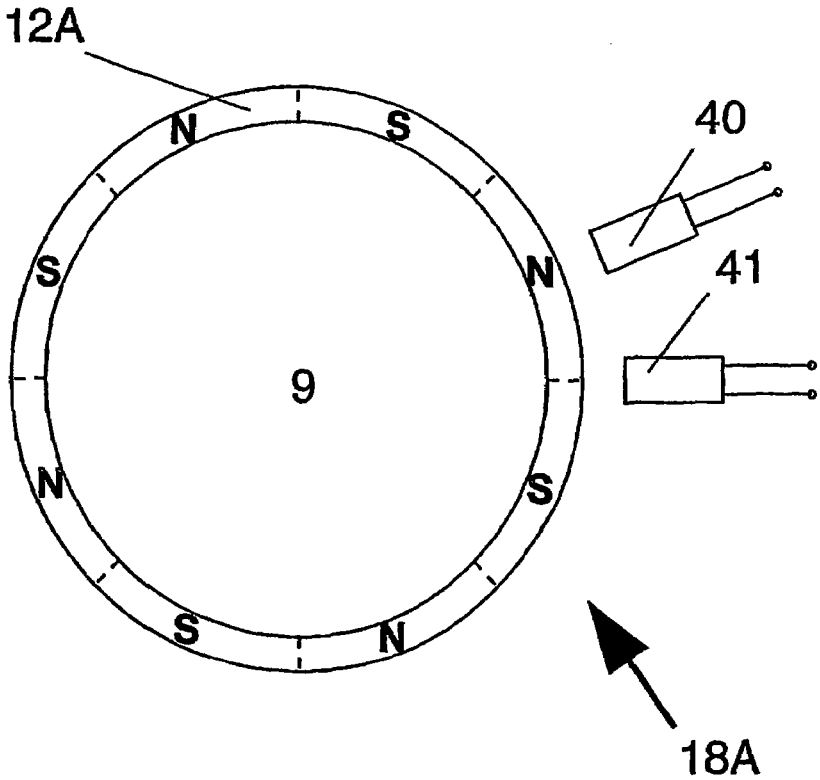

In the following, the invention will be described in more detail by way of preferred exemplary embodiments illustrated in the drawing, to which it is, however, not to be restricted. In detail:

FIG. 1 schematically illustrates a room lighting system according to the invention;

FIG. 2 schematically depicts the options of adjustment with such a room lighting system;

FIG. 3 shows a modified embodiment of such a room lighting system, comprising an adapter unit in front of a ceiling lamp;

FIG. 4, in schematic cross section, shows a detail of a configuration of the prism elements comprising a plurality of linear prism regions in the manner of Fresnel plates, frosting or blackening being also indicated on the vertical step surfaces;

FIGS. 5 and 6 in schematic top views show embodiments of the prism elements, in which direct drive means including a step motor are provided for driving the prism elements; and FIGS. 7, 7A, 7B and 7C depict a further embodiment of a prism element direct drive means in an axonometric illustration, in top view and in an elevational view, respectively.

In the exemplary embodiment of a room lighting system 1 illustrated in FIG. 1, a housing 2 is installed in a ceiling panel 3 of a room and held there by the aid of claws 4, said housing 2 having a collar or flange 5 abutting on the celing panel 3 and overlapping an edge region of a bore provided in the ceiling panel 3.

A reflector 6 is mounted in the housing 2, the mounting for the reflector 6 being not illustrated for the sake of clarity. In any event, the reflector 6 is rigidly connected with the housing 2.

A light source 7 of any design, e.g. a lamp, is mounted within the reflector 6. The reflector 6, moreover, comprises a socket 7' for the light source 7, which also receives supply lines (not illustrated) that serve to supply the necessary electric power to the light source 7.

Below the light source 7, an optical component 8 such as a color filter and/or a lens and/or a color changer is arranged substantially coaxially with the reflector 6.

At least two substantially wedge-shaped refractive prism elements 9, 10 each mounted to be separately rotatable are arranged below this optical component 8, said prism elements 9, 10 too being arranged coaxially with the reflector 6 and rotatable about the beam axis 11, i.e., the optical axis of the light source 7 plus reflector 6. The arrangement of the two prism elements 9, 10 is preferably further designed in a manner that the axis of symmetry of the wedge angle of each of the two prism elements 9, 10 extends substantially perpendicular to the beam axis 11, as illustrated.

The two refractive prism elements 9, 10 in top view have substantially circular shapes (cf. also FIG. 2), each carrying a toothed ring 12 about their circumferences. In principle, the prism elements 9, 10 might also be square-shaped or rectangular. These prism elements 9, 10 may also correspond to regular polygons, e.g. a regular hexagon. Yet, in the latter cases, differences in brightness on the generated light cone surface may occur on account of the corner regions of such refractive prism elements, which may, however, be desired in order to obtain special effects.

The toothed rings 12 each mesh with a pinion 13, which is connected with a shaft 14 in a rotationally fixed manner. The shafts 14 are each mounted in a flange 15 fixed to the housing, and connected with a toothed wheel 16 in a rotationally fixed manner. The shafts 14 are further mounted in an upper structural part (not illustrated). The toothed wheels 16, in turn, each mesh with a drive pinion 17 that is drivable by a motor 18 or 19, respectively.

It goes without saying that any modified drive means configuration is also conceivable, it being feasible for the motors 18, 19—which are preferably realized as step motors—to drive the shafts 14 directly (i.e. without toothed wheels 16, 17), wherein the shafts 14 may constitute the output shafts of the motors 18, 19 or extensions thereof.

The control of the two motors 18, 19 is effected via a control unit 20, which also supplies the respective voltage to the light source 7 and is influenceable via a remote control unit 21 illustrated just schematically. This control unit 20, in the event of motors 18, 19, which are preferably designed as step motors, contains a motor step counting module 20', as is schematically indicated in FIG. 1 (and 3), in order to enable motor positions to be stored, and subsequently reselected, by the counting and storing of steps.

As is particularly apparent from FIG. 2, the two refractive prism elements 9, 10 are rotatable independently of each other. In doing so, the light beam of the light source 7, that passes through the upper refractive prism element 9 in FIG. 1 is refracted towards the thicker region of the refractive prism element 9. And this refracted light beam is refracted a second time by the second refractive prism element 10.

By appropriately rotating one or both of the refractive prism elements 9, 10, the light cone emerging from the light source 7, or the light cone surface generated by the same on a projection surface, can be moved over an area enclosed by line 22. Instead of a lamp, the light source 7 may, for instance, also be comprised of a LED or plurality of LEDS.

In this case, it may be provided that the two refractive prism elements 9, 10 are constantly kept in rotation, which will not involve any problems in connection with the supply lines leading to the light source 7, since the reflector 6 is fixedly mounted. It is, however, also feasible to rotate one of the prism elements 9, 10, or both prism elements 9, 10, merely for changing the angle of emergence of the light beam from the room lighting system 1 and leave them in the desired position after having reached the same. This will actually depend on the desired optical effect.

In the exemplary embodiment represented in FIG. 1, the refractive prism elements 9, 10 are provided with substantially plane wedge or prism surfaces 23, 24 and 25, 26, respectively. If desired, these (or some) wedge surface 23 to 26 may, however, also be convexly or concavely designed as schematically illustrated by broken lines in FIG. 1 at 23', or 26', respectively, in order to enable the focussing or scattering of the light beam passing through these prism elements 9, 10. In such a case, it is, however, also essential that a substantially wedge-shaped form of these refractive prism elements 9, 10 will be retained.

Instead of the round shape of the refractive prism elements 9, 10 as provided in the embodiment illustrated, these prism elements 9, 10 may have any other shapes, e.g., square shapes. It is merely important that these prism elements 9, 10 be arranged "concentrically" with the beam axis 11 and rotatable about the same. It is, furthermore, feasible to replace the positive drive via toothed rings 12 and pinions 13 with a friction drive for the refractive prism elements 9, 10, wherein said prism elements 9, 10 may, for instance, be provided each with a ring of an elastomer material, which rings would cooperate with drivable friction wheels.

FIG. 3 in an exemplary manner depicts a usual ceiling lamp 1' including a light source 7 mounted within a reflector 6. The reflector 6, in turn, is mounted in a housing 2' of the ceiling lamp 1', wherein an optical element 8 is again arranged within the housing 2'. The ceiling lamp 1' according to FIG. 3 substantially corresponds with the lamp according to FIG. 1, yet the housing 2' does not contain any refractive prism element. Instead, a front adapter unit 27 including refractive prism elements 9, 10 is mounted to the housing 2' of the ceiling lamp 1'.

This adapter unit 27 comprises its own housing 28, which is provided with a flange 29 fastened to the flange 5 of the housing 2' of the ceiling lamp 1' by brackets 30.

The two refractive prism elements 9, 10 are rotatably mounted in the housing 28 and provided with bevelled toothed rings 12', which are driven by bevel pinions 13' actuated by motors 18, 19. The refractive prism elements 9, 10 and their bevelled toothed rings 12', respectively, are supported on two further bevel pinions (not illustrated), said altogether three bevel pinions simultaneously ensuring the centering of the respective refractive prism element 9, 10.

The control of the motors 18, 19 is again realized via a control unit 20, a control electronics fed by a power supply line 31 introduced into the housing 28 through a passage 32. The supply line 31 is, for instance, also led through the ceiling panel 3.

The adapter unit 27 enables a conventional ceiling lamp 1' to be retroactively equipped with a room lighting system 1 according to the invention, which, in combination with the adapter unit 27, will function in the same manner as the room lighting system 1 according to FIG. 1.

The adapter unit 27, along with the housing 28 in which the two independently rotatable prism elements 9, 10 are arranged, may be used as an adapter for any lamp, and mounted to the housing of the same in front of the light source, respectively. The invention, thus, also relates to a room lighting system in the form of such an adapter unit, which contains, in a housing 28, at least two substantially wedge-shaped refractive prism elements 9, 10 which are rotatably mounted, arranged in alignment relative to the beam axis 11 of the light source 7, and rotatable independently of each other. The prism elements 9, 10 provided in the housing 28 of the adapter unit 27 essentially have the same characteristic features as previously described. Said adapter unit 27 enables the retrofitting of any room luminaire with the adapter unit 27 acting as a light direction unit. In doing so, it is suitable to provide that the adapter unit 27 and the lighting system 1' comprise connecting elements such as the brackets 30, but also any other plug-in, screw and/or latch elements, for mutual connection.

In principle, it is also feasible to fasten the adapter unit 27 not to the room lamp 1' itself, but to the wall or ceiling portions surrounding the lamp.

In FIG. 4, two refractive prism elements 9, 10 are schematically illustrated, the remaining components of the room lighting system having been omitted for the sake of simplicity; in this respect, it may be referred to FIG. 1 or FIG. 3. FIG. 4 only rather schematically depicts bearings 33, 34 for prism elements 9, 10, which are again mounted to be rotatable independently of each other, yet their drive means have been omitted. The drive means may, however, be designed as in FIG. 3 or as illustrated in FIG. 5, 6 or 7 below.

According to the illustration of FIG. 4, the prism elements 9, 10 each comprise several linear prism regions 35 extending at right angles relative to the central axis, namely the optical axis or beam axis 11, which also defines the axis of rotation. In schematic cross section, a single-saw-tooth-shaped contour in the manner of a Fresnel plate (cf. the upper prism element 9 in FIG. 4) or a double-saw-tooth-shaped contour (cf. the lower prism element 10 in FIG. 4) will hence result. Surfaces 36, which are vertical in FIG. 4 and extend substantially parallel with the beam axis 11 (but may, however, also be inclined at a small angle relative to the beam axis 11) may lead to undesired internal total reflections as indicated at 37 in FIG. 4 by way of example. In order to counter such a negative internal total reflection, the surfaces 36 may be roughened or frosted or even blackened, as is schematically indicated by thickened lines in FIG. 4. In the event of roughened or frosted surfaces 36, a light beam that would otherwise be totally reflected will consequently be allowed to pass due to the profiled surface 36, as is schematically indicated at 38 in FIG. 4. In the case of blackening, the light beam will be absorbed and converted into heat. In both cases, an undesired total reflection will be avoided or at least largely reduced.

FIG. 5 is a schematic top view on one of the prism elements, e.g. 9 (or 10), which is again circular in top view and which is now surrounded by an annular armature 12A instead of a toothed ring 12 as shown in FIG. 1, said annular armature in the example of FIG. 5 being composed of a toothed soft-iron core and constituting the rotor of the respective electromotor 18A (or 19A, respectively). In the exemplary embodiment illustrated, two electric coils 40, 41 are associated with said rotor, i.e. armature 12A, to form the stator of the electromotor 18A (or 19A, respectively). In this manner, a simple direct drive for the respective prism element, e.g. 9, is obtained, wherein, by the appropriate supply of the coils 40, 41 with pulses, a step motor will be realized, which will be controlled by the respective control unit 20 (not illustrated) according to FIG. 1 or 3. The respective connections are obvious to the skilled artisan and, therefore, not illustrated in detail in FIG. 5 (nor in the following FIGS. 6 and 7A to 7C).

FIG. 6 likewise depicts a comparable motor 18A in the form of a direct-drive step motor whose armature 12A, which again surrounds the respective prism element, e.g. 9, is formed by a permanent magnet ring comprising ring segments each defining a magnetic north and a magnetic south, i.e. being alternately magnetized. Again, two coils 40, 41 are laterally associated with this armature 12A to serve as the stator of the motor 18A.

Figure 7A:
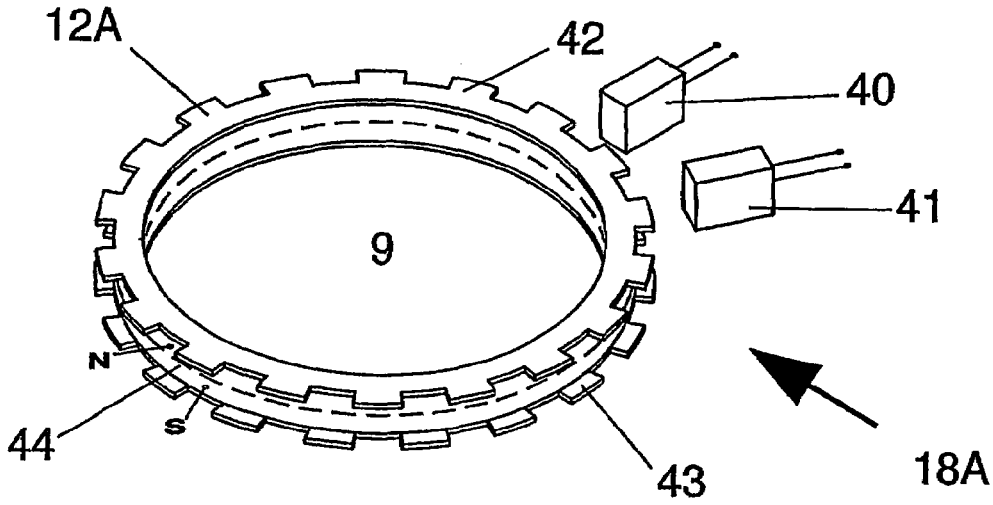
Figure 7B:
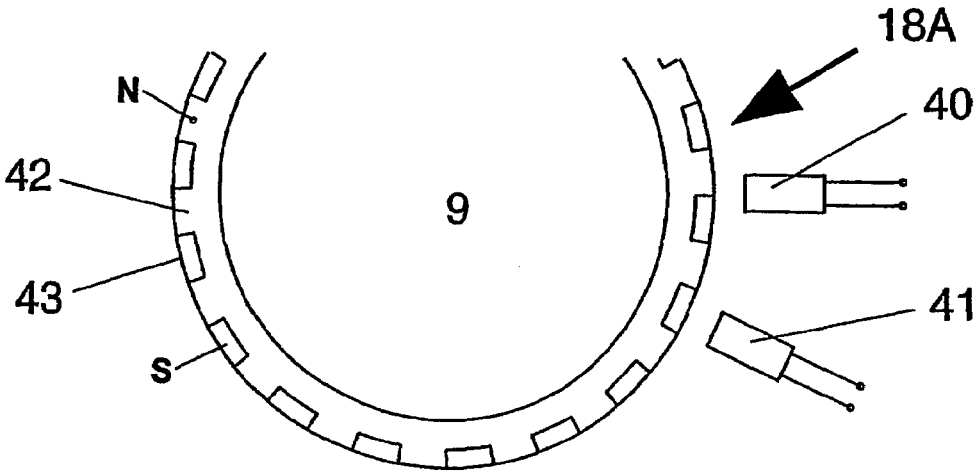
Figure 7C:
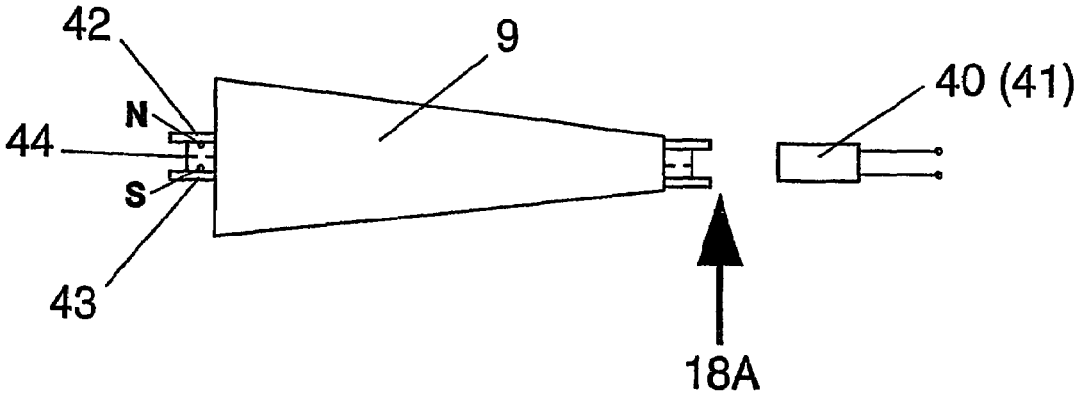

FIGS. 7A to 7C depict a variant embodiment of the direct-drive motor 18A (or 19A), in this case, for instance, for the prism element 9, which motor 18A constitutes a hybrid step motor. In detail, an armature 12A again surrounds the respective prism element, e.g. 9, as a rotor, said armature 12A in the instant case being comprised of an upper toothed iron ring 42 and a lower toothed iron ring 43, with a permanent magnet ring 44 being arranged between these two toothed iron rings 42, 43. As is apparent from FIG. 7A, the upper toothed iron ring 42 is preferably offset relative to the lower toothed iron ring 43 in the circumferential direction, particularly by half a tooth distance.

At least two coils 40, 41 are again associated with the thus formed rotor of the motor 18A laterally, i.e., radially outwards of the same.

In all of the embodiments according to FIGS. 5, 6 and 7A to 7C, the coils 40, 41 (as well as optionally further coils) are stationarily arranged in the housing 2 (according to FIG. 1, and 28 according to FIG. 3), and the prism elements 9, 10 along with the armatures 12A are rotatably mounted in bearings such as the bearings 33 and 34, respectively, which are indicated in FIG. 4. The bearings 33, 34 are, of course, consequently interrupted on the sites of the coils 40, 41.

The invention claimed is:

1. A room lighting system comprising a light source defining a beam axis as well as two alignedly arranged refractive elements having centers which are substantially located in the beam axis, one of said refractive elements being rotatably mounted about said beam axis, wherein the second of said refractive elements is rotatably mounted about said beam axis, wherein a drive means and a control means are associated with the two refractive elements for selective rotation in the same sense or in opposite senses, wherein both of said refractive elements are prism elements, and wherein at least the two refractive prism elements are arranged in a common housing.

2. A room lighting system according to claim 1, wherein at least one refractive prism element comprises a lens-like bulge on at least one prism surface.

3. A room lighting system according to claim 1, wherein at least one refractive prism element comprises a lens-like depression on at least one prism surface.

4. A room lighting system according to claim 1, wherein the refractive prism element arranged farther remote from the light source, in a plane perpendicular to the beam axis of the light source, is at least as large as the refractive prism element arranged closer to the light source, and is preferably equally designed.

5. A room lighting system according to claim 1, wherein the refractive prism elements have circular cross sections.

6. A room lighting system according to claim 1, wherein a separate motor is provided as a drive means for each of said refractive prism elements.

7. A room lighting system according to claim 6, wherein the refractive prism elements are each surrounded by a toothed ring which meshes with a pinion connected to the associated motor.

8. A room lighting system according to claim 6, wherein the motors are arranged near the light source and drive the individual refractive prism elements via shafts extending parallel with the beam axis of the light source.

9. A room lighting system according to claim 6, wherein the two refractive prism elements are each surrounded by an annular armature, which constitutes the rotor of a respective electromotor additionally comprising, laterally of said armature, a stator including at least two coils.

10. A room lighting system according to claim 6, wherein the motors are step motors.

11. A room lighting system according to claim 10, wherein a control means including a motor step counting module is associated with the motors step motors for the storage and selection of a position.

12. A room lighting system according to claim 1, wherein also the drive means plus control means as well as the light source, which is preferably associated with a reflector, are arranged in the common housing.

13. A room lighting system according to claim 1, wherein the drive means of the refractive prism elements are controllable via a remote control.

14. A room lighting system according to claim 1, wherein at least one optical component is arranged between the light source and the refractive prism elements.

15. A room lighting system according to claim 1, wherein an adapter unit is mounted to a housing containing the light source, which adapter unit comprises the common housing in which the two refractive prism elements are arranged.

16. A room lighting system according to claim 15, wherein the adapter unit and the housing of the light source comprise connecting members for mutual connection.

17. A room lighting system according to claim 1, wherein the refractive prism elements are each designed with a plurality of linear prism regions or prism parts in the manner of Fresnel screens.

18. A room lighting system according to claim 17, wherein the prism regions are frosted or blackened on their surfaces extending at least substantially parallel with the beam axis so as to avoid total reflection.

19. A room lighting system according to claim 1, wherein that room lighting system is an architectural lighting system.

20. A room lighting system according to claim 1, wherein the two refractive prism elements define wedge angles having symmetric lines which extend substantially perpendicular to the beam axis of the light source.

21. A room lighting system according to claim 14, wherein the optical component is a color filter.

22. A room lighting system according to claim 14, wherein the optical component is a lens.

23. A room lighting system according to claim 14, wherein the optical component is a color changer.

24. A room lighting system comprising a light source defining a beam axis as well as two alignedly arranged refractive elements having centers which are substantially located in the beam axis, one of said refractive elements being rotatably mounted about said beam axis, wherein the second of said refractive elements is rotatably mounted about said beam axis, said refractive elements being capable of selective rotation in the same sense or in opposite senses, wherein both of said refractive elements are prism elements, and wherein at least the two refractive prism elements are arranged in a common housing.

25. A room lighting system according to claim 24, wherein at least one refractive prism element comprises a lens-like bulge on at least one prism surface or a lens-like depression on at least one prism surface.

26. A room lighting system according to claim 24, wherein the refractive prism element arranged farther remote from the light source, in a plane perpendicular to the beam axis of the light source, is at least as large as the refractive prism element arranged closer to the light source, and is preferably equally designed.

27. A room lighting system according to claim 24, wherein a separate motor is provided for selective rotation for each of said refractive prism elements.

28. A room lighting system according to claim 27, wherein the refractive prism elements are each surrounded by a toothed ring which meshes with a pinion connected to the associated motor.

29. A room lighting system according to claim 27, wherein the motors are arranged near the light source and drive the individual refractive prism elements via shafts extending parallel with the beam axis of the light source.

30. A room lighting system according to claim 27, wherein the two refractive prism elements are each surrounded by an annular armature, which constitutes the rotor of a respective electromotor additionally comprising, laterally of said armature, a stator including at least two coils.

31. A room lighting system according to claim 24, wherein at least one optical component is arranged between the light source and the refractive prism elements.

32. A room lighting system according to claim 24, wherein an adapter unit is mounted to a housing containing the light source, which adapter unit comprises the common housing in which the two refractive prism elements are arranged.

33. A room lighting system according to claim 24, wherein the refractive prism elements are each designed with a plurality of linear prism regions or prism parts in the manner of Fresnel screens.

34. A room lighting system according to claim 24, wherein that room lighting system is an architectural lighting system.

35. A room lighting system according to claim 24, wherein the two refractive prism elements define wedge angles having symmetric lines which extend substantially perpendicular to the beam axis of the light source.

36. A room lighting system according to claim 24, wherein the optical component a member selected from the group consisting of is a color filter, a lens, and a color changer.

* * * * *